United States Patent [19]

Davies

[11] Patent Number: 4,905,563

[45] Date of Patent: Mar. 6, 1990

[54] STRINGED MUSICAL INSTRUMENT

[76] Inventor: James S. Davies, 702 Blanchard, Seattle, Wash. 98121

[21] Appl. No.: 289,619

[22] Filed: Dec. 23, 1988

[51] Int. Cl.[4] ..... G10D 1/08

[52] U.S. Cl. ..... 84/291; 84/293

[58] Field of Search ..... 84/291, 293

[56] References Cited

U.S. PATENT DOCUMENTS

| | | | |
|---|---|---|---|
| 509,507 | 11/1893 | Anderson | 84/293 |
| 1,932,975 | 10/1933 | Kuhrmeyer | 84/293 |
| 3,678,795 | 7/1972 | Fullerton | 84/293 |
| 4,432,267 | 2/1984 | Feller | 84/293 |

*Primary Examiner*—Lawrence R. Franklin

*Attorney, Agent, or Firm*—Graybeal, Jensen & Puntigam

[57] ABSTRACT

A stringed musical instrument wherein the interconnection between the main body portion and the neck is arcuate in shape whereby the two parts may be quickly and easily aligned during manufacture without requiring a restructuring.

4 Claims, 2 Drawing Sheets

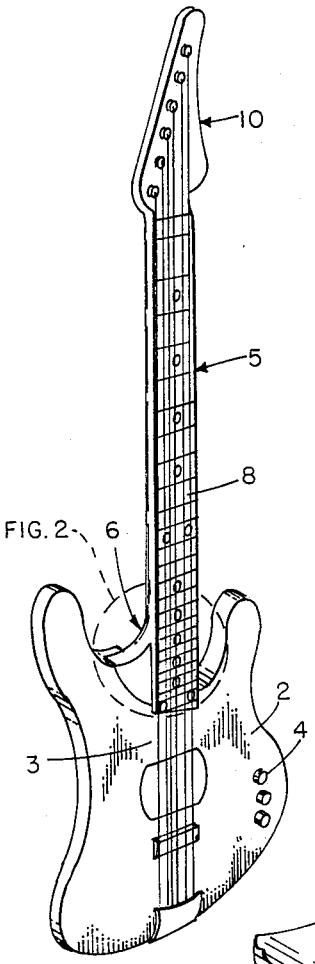
FIG. 1
FIG. 2
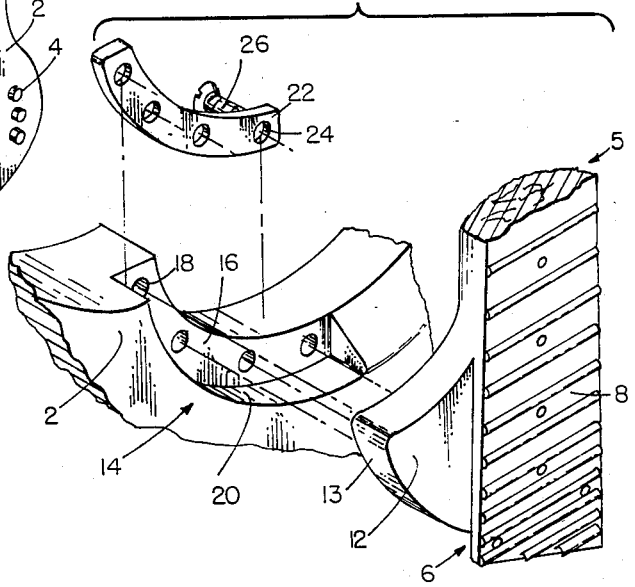

STRINGED MUSICAL INSTRUMENT

DESCRIPTION

1. Technical Field

The present invention is directed towards the field of stringed musical instruments and in particular towards an inexpensive and relatively simple method of joining the separately manufactured neck and the body of a stringed musical instrument, such as a guitar, while permitting relative angular adjustment during fabrication to assure proper alignment.

2. Background Art

People have manufactured and played stringed instruments for many years and the most desirable and best toned instruments are handmade. These instruments are also the most expensive. There is, however, a large demand for stringed musical instruments of a lesser quality, which do not require the skill and time necessary to fabricate a handmade instrument. In fact, a substantial number of instruments are machine made. Whereas, handmade instruments are by and large secured by mortise and tenon type joinders reinforced by glue, many of the less expensive machine made instruments include a neck that is mechanically affixed to the body by bolts, screws or the like.

Prior art references which illustrate the means connecting the neck of a stringed instrument to the body include U.S. Pat. No. 2,335,244 granted to Gugino, Nov. 30, 1943, which illustrates, in FIG. 3, a mortise and tenon joint.

U.S. Pat. No. 2,478,136 granted to Strongberg, Aug. 2, 1949, shows the attachment between the neck and the neck block of a stringed instrument.

U.S. Pat. No. 2,498,926 granted to Mitchell, Feb. 28, 1950, illustrates a guitar body construction but omits details with respect to the interconnection between the neck and the body.

U.S. Pat. No. 2,793,556 granted to Maccaferri, May 28, 1957. Specifically deals with the neck junction for stringed musical instruments and illustrates a mechanical securement system wherein the portion of the neck which joins the body is primarily rectangular.

U.S. Pat. No. 3,091,150 granted to Sceusa, May 28, 1963, does not disclose the neck joinder.

U.S. Pat. No. 3,143,028 granted to Fender, Aug. 4, 1964, illustrates a mechanical joinder between the neck and body of a guitar or the like and it would appear that the foot of the neck is rectangular.

U.S. Pat. No. 3,392,618 granted to Pelensky, July 16, 1968, illustrates a multi-range fretted guitar but does not disclose the details of the neck joinder.

U.S. Pat. No. 3,443,018 granted to Krebs, May 6, 1969, illustrates a guitar or the like Wherein the neck is long enough to support the entire fretboard and strings and thereby removing some of the stress on the joint between the fretboard and the body, the method of securing the neck is not shown.

U.S. Pat. No. 3,858,480 granted to Schneider et al, Jan. 7, 1975, discloses a stringed musical instrument of a non-traditional shape. The particular shape is used to relieve the stress generated on the neck joint in a traditional musical instrument.

U.S. Pat. No. 4,126,073 granted to Takabayashi, Nov. 21, 1978, discloses an electric guitar wherein the neck is a single piece which extends through the entire body and the joinder of the body is done by gluing, laminating or the like.

U.S. Pat. No. 4,291,606 granted to LaPage, Sept. 29, 1981, discloses a stringed musical instrument of a unique configuration but does not disclose the method of joining the neck.

U.S. Pat. No. 4,616,550 granted to Lacroix et al, Oct. 14, 1986, discloses a string support and neck device for a musical instrument and illustrates in FIGS. 13–18 a mechanical method of securing the neck to the body by threaded fasteners. It is to be noted that the end of the neck where it joins the body is rectangular.

U.S. Pat. No. D. 224,155 granted to Smith, July 4, 1972, discloses a guitar having a non-traditional cutaway but does not disclose the neck to body joinder.

DISCLOSURE OF THE INVENTION

With the above noted prior art in mind, it is an object of the present invention to provide a joint between the body and the neck of a stringed musical instrument which has sufficient strength to withstand the bending stress generated by the strings under tension and further is simple enough that the parts of the instrument may be machine made with normal machining tolerances and yet does not require a substantial amount of finish work to produce a visually acceptable guitar.

Yet another object of the present invention is to provide a simple clean joint between the body and the neck of a stringed musical instrument facilitating rapid assembly while permitting slight relative adjustment to assure proper positioning of the separately fabricated parts.

It is still another object of the present invention to provide a simple joint between the body and the neck of a stringed musical instrument which is both simple and attractive while allowing an alignment of the parts.

Still a further object of the present invention is to provide a joint between the neck and the body of a stringed musical instrument incorporating an arc of a circle such that the two pieces may be aligned by moving the neck within the arcs without affecting appearance or strength.

Yet another object of the present invention is to provide a joint between two bodies incorporating congruent arcs permitting greater ease and accuracy during fabrication.

BRIEF DESCRIPTION OF THE DRAWINGS

FIG. 1 is an isometric view of an electric guitar utilizing the joint of the present invention.

FIG. 2 is an exploded view of the neck to body joint of the present invention as seen within the encircled portion of FIG. 1.

BEST MODE FOR CARRYING OUT THE INVENTION

Figure 3:
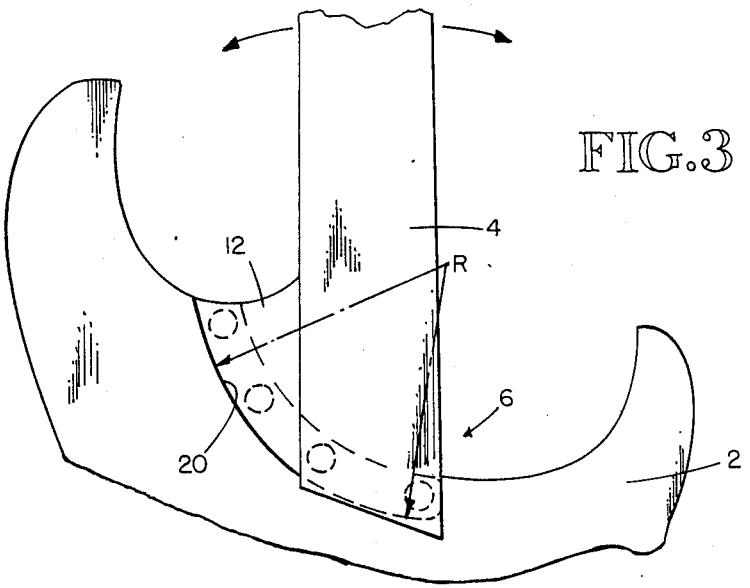
FIG. 3 is a top plan view of a guitar assembled utilizing the inventive joint.

Reference is now had to FIG. 1, wherein, for illustrative purposes, an electric guitar is shown having a main body portion 2, including the securement for the strings 3, the controls 4, and the other standard elements. Secured to the upper end of the main body portion is a neck 5 having an outwardly flared foot or heel portion 6 for interconnecting with the body 2, a fretboard 8 and the necessary string tensioning devices 10.

Referring now to FIG. 2, the heel of the neck 5 may be more readily seen and the lower end of the fretboard 8 along with the laterally projecting ear 12 of the foot or heel 6 are clearly depicted. The laterally projecting ear 12 of the foot or heel 6 of the neck 5 has a lower outwardly facing surface 13 in the shape of an arc of a circle.

Also seen in FIG. 2 is the upper portion of the main body 2 including an outwardly facing rabbet or recess 14 which includes a flat back portion 16 having a plurality of holes 18 bored therethrough and a curved base 18 which is arcuate in configuration and congruent with the arcuate portion 13 of neck 5. It is to be understood that a mortise and tenon joint, although more expensive, could also be used if arcuate in configuration.

An operational metallic reinforcing plate 22 is secured to the back of the guitar main body and includes a plurality of bores 24 to accept fasteners 26 which pass through bores 24 and 18 and are secured to the foot 12. Washers or other reinforcing means could also be used.

Reference is now had to FIG. 3 which shows the neck 5 and body 2 in assembled condition wherein the arcuate surface of the ear 12 and the remainder of the foot or heel 6 of the neck are mounted adjacent the arcuate portion 20 of the main body portion. As can be seen in this view, the back surface 20 of the shelf and the outer surface of the foot 6 have an identical radius R such that they form a smooth joint.

It is to be noted that the front surface of the neck 5 i.e. the fretboard 8 extends slightly beyond the radius R of the foot allowing the neck 4 to be moved angularly as indicated by the arrows with respect to the base such that it can be properly aligned. The angular movement to accommodate manufacturing tolerance does not expose gaps along the edge 20 because of the congruent surfaces and thus the alignment can be made without requiring restructuring.

Thus as can be seen, a guitar can be fabricated by machine and the joinder between the body and the neck of a guitar is a simple joint but yet a joint which allows for some manufacturing tolerance and yet permits a rapid and easy correction of the alignment of the two separately manufactured elements without requiring cosmetic work.

I claim:

1. A stringed musical instrument including a body, an attached extending neck, a fret board overlying the neck and a part of the body, and a plurality of strings overlying the neck and the body, the improvement comprising:

a joinder of the neck and body, said neck including a laterally extending foot having substantially parallel upper and lower surfaces and being substantially parallel to the surface of the fret board, said foot including an arcuate outer edge having an axis of curvature substantially perpendicular to the upper and lower surfaces of said foot, a recess in said body complementary in shape to said foot to receive the foot, and means to secure the foot to the body.

2. A stringed musical instrument as in claim 1, wherein the laterally extending foot results in the neck being substantially wider than the fret board at the base of the neck.

3. A stringed musical instrument as in claim 1, wherein the wider base and the larger surface area effectively resists the turning moment generated by the strings.

4. A stringed musical instrument as in claim 1, wherein the arcuate shape of the mating foot and body permits lateral adjustment of the neck relative to the body during assembly assuring proper alignment.

* * * * *